US009586710B2

(12) United States Patent
Sussmeier et al.

(10) Patent No.: US 9,586,710 B2
(45) Date of Patent: Mar. 7, 2017

(54) METHOD AND SYSTEM FOR IDENTIFYING/OUTSORTING IMPROPERLY WRAPPED ENVELOPES IN A MAILPIECE FABRICATION SYSTEM

(71) Applicants: John W. Sussmeier, Cold Spring, NY (US); Xavier Padros, New Milford, CT (US)

(72) Inventors: John W. Sussmeier, Cold Spring, NY (US); Xavier Padros, New Milford, CT (US)

(73) Assignee: Pitney Bowes Inc., Stamford, CT (US)

( * ) Notice: Subject to any disclaimer, the term of this patent is extended or adjusted under 35 U.S.C. 154(b) by 926 days.

(21) Appl. No.: 13/646,254

(22) Filed: Oct. 5, 2012

(65) Prior Publication Data

US 2014/0096477 A1 Apr. 10, 2014

(51) Int. Cl.

| | |
|---|---|
| ***B65B 57/02*** | (2006.01) |
| ***B65B 51/02*** | (2006.01) |
| *B65B 11/48* | (2006.01) |
| *B43M 5/04* | (2006.01) |
| *B65B 9/067* | (2012.01) |

(52) U.S. Cl.

CPC ..... *B65B 57/02* (2013.01); *B43M 5/04* (2013.01); *B65B 51/023* (2013.01); *B43M 5/042* (2013.01); *B65B 9/067* (2013.01)

(58) Field of Classification Search

CPC ..... B65B 9/067; B65B 57/02; B65B 57/04; B65B 57/10; B43M 3/04; B43M 3/045; B43M 5/04; B43M 5/042; G06K 9/20; G06K 9/2054; G06K 9/2018; B07C 5/342; B07C 5/3416; B07C 5/34; B07C 3/14

USPC ..... 53/53, 396, 450, 460, 461, 504, 569; 382/101, 141, 143, 152; 270/58.06; 73/52, 865.8; 700/220

See application file for complete search history.

(56) References Cited

U.S. PATENT DOCUMENTS

| | | | | |
|---|---|---|---|---|
| 4,011,155 A * | 3/1977 | Feurstein | ..... | B07C 5/3412 156/351 |
| 5,515,159 A * | 5/1996 | Sites | ..... | G01N 21/95 348/131 |
| 5,555,701 A | 9/1996 | Fehringer et al. | | |

(Continued)

FOREIGN PATENT DOCUMENTS

GB 2147885 A 5/1985

*Primary Examiner* — Gloria R Weeks
*Assistant Examiner* — Justin Citrin
(74) *Attorney, Agent, or Firm* — Michael J. Cummings; Charles R. Malandra, Jr.; Steven J. Sharpiro

(57) ABSTRACT

A method and system for identifying and detecting improperly wrapped envelopes for use in a mailpiece fabrication system. The method/system visually images each envelope in predetermined regions of interest (ROIs) to determine the spatial relationship between the internal content material and one or more points of reference indicative of the internal bounds of a sealing adhesive. By examining the spatial relationship, a determination is made regarding the proximity of the internal content material and the sealing adhesive. If the distance, or spatial separation, therebetween is below a threshold value, then an assumption is made that the content material and sealing adhesive are contiguous and that the envelope has been improperly sealed, i.e., with the content material interposing or otherwise inhibiting the proper closure of the wrapped envelope.

19 Claims, 7 Drawing Sheets

(56) References Cited

U.S. PATENT DOCUMENTS

| | | | | |
|---|---|---|---|---|
| 5,841,881 | A * | 11/1998 | Iwakawa | B07C 3/14 382/101 |
| 6,903,359 | B2 * | 6/2005 | Miller | G01V 8/20 250/223 R |
| 7,142,707 | B2 * | 11/2006 | Abdollahi | G01N 21/95 382/108 |
| 7,222,472 | B2 * | 5/2007 | Spatafora | B65H 16/103 53/396 |
| 7,398,635 | B2 * | 7/2008 | Fairweather | B43M 3/045 53/284.3 |
| 7,752,009 | B2 * | 7/2010 | Nicolas | G07B 17/00661 198/502.2 |
| 7,918,071 | B2 * | 4/2011 | Reichelsheimer | B65B 27/14 53/460 |
| 8,073,239 | B1 * | 12/2011 | Bahrami | G06T 7/001 382/141 |
| 2003/0044056 | A1 * | 3/2003 | Katt | G01N 21/89 382/143 |
| 2005/0006445 | A1 | 1/2005 | Katz | |
| 2007/0251192 | A1 * | 11/2007 | Fairweather | B43M 3/045 53/284.3 |
| 2008/0019563 | A1 * | 1/2008 | Goodwin | B07C 1/18 382/101 |

* cited by examiner

METHOD AND SYSTEM FOR IDENTIFYING/OUTSORTING IMPROPERLY WRAPPED ENVELOPES IN A MAILPIECE FABRICATION SYSTEM

TECHNICAL FIELD

The present invention relates to mailpiece fabrication systems, and, more particularly, to a method and system for identifying improperly wrapped content material of a mailpiece fabrication system such that the wrapped envelope may be out-sorted before additional mailpiece processing.

BACKGROUND OF THE INVENTION

Mailpiece fabrication systems such as mailpiece inserters and mailpiece wrappers are typically used by organizations such as banks, insurance companies, and utility companies to periodically produce a large volume of mail, e.g., monthly billing or shareholders income/dividend statements. In many respects, mailpiece inserters are analogous to automated assembly equipment inasmuch as sheets, inserts and envelopes are conveyed along a feed path and assembled in, or at, various modules of the mailpiece inserter. That is, the various modules work cooperatively to process the sheets until a finished mailpiece is produced.

Mailpiece inserters include a variety of apparatus/modules for conveying and processing a substrate/sheet material along the feed path. Commonly mailpiece inserters include apparatus/modules for (i) feeding and singulating printed content in a "feeder module", (ii) accumulating the content to form a multi-sheet collation in an "accumulator", (iii) folding the content to produce a variety of fold configurations such as a C-fold, Z-fold, bi-fold and gate fold, in a "folder", (iv) feeding mailpiece inserts such as coupons, brochures, and pamphlets, in combination with the content, in a "chassis module" (v) inserting the folded/unfold and/or nested content into an envelope in an "envelope inserter", (vi) sealing the filled envelope in "sealing module" and (vii) printing recipient/return addresses and/or postage indicia on the face of the mailpiece envelope at a "print station".

In lieu of modules for inserting and/or sealing the content material into an "envelope", some mailpiece fabrication systems employ a wrapping system operative to encapsulate the mailpiece content in an outer wrapping material or substrate. Therein, the content material is fed into a substrate/wrap having a pressure-activated adhesive deposited thereon to enclose/seal the content material in a tubular-shaped envelope wrap. More specifically, the content material is fed into a wrapping module which receives a supply of substrate material from a web of rolled material. Before being fed to the wrapping module, an adhesive application module deposits a polymeric adhesive in a predefined two-dimensional pattern on the substrate material. As the substrate material is folded by the wrapping system, an envelope pocket is produced for receipt of the content material.

More specifically, the supply of substrate material is fed from beneath the deck of the wrapping module and turned downstream to define an open-end for accepting a supply of content material. As the substrate and content material is pulled downstream, a one or more guides fold the substrate material inwardly such that the outboard edge portions overlap. Furthermore, a tube-shaped wrap is produced around the content material as the substrate material is drawn together downstream of the open end. The content-filled tubular structure then is passed under a series of pressure rollers to cause the pressure-activated adhesive to form a series of individual pockets having content material in each. Thereafter, the wrapping module includes a cutting roller to separate the content-filled pockets into separate envelopes.

To obtain the throughput advantages of a mailpiece fabrication system, and especially one employing a wrapping system, it is important to maintain the reliability and minimize the downtime of the fabrication system. While a variety of mailpiece fabrication errors can occur to adversely impact throughput, one of the more frequent sources originates from the handling apparatus of the wrapping module. More specifically, difficulties arise when placing the content material into the open end of the tube-shaped wrap such that the content material is placed into and remains at the proper location relative to adhesive deposited along the peripheral edges of the mailpiece.

For example, if the content material shifts longitudinally, i.e., in the direction of the feed path, as the wrapping material is folded over content material, then the edges of the content material may be trapped in one of the bond lines forming the pocket of the envelope. Thereafter, when the tube-shaped wrap is rolled through the pressure rollers and cut into envelopes by the cutting roller, there is no reliable method or system to identify when an envelope has been improperly fabricated.

Should a positioning error occur in the phase nip roller, many envelopes may be incorrectly fabricated before identification and eradication of the error. Inasmuch as the processing error may go unnoticed during mailpiece fabrication, the potential exists for many mailpieces may be delivered with internal content material adhesively bonded to the external wrapping material. Additionally, since the content material may prevent proper sealing of the envelope, a mailpiece may remain open during delivery. As a result, confidential or sensitive information contained in the mailpieces may be inadvertently compromised.

A need, therefore, exists for a method and system for identifying/outsorting improperly fabricated/unsealed envelopes in a mailpiece fabrication system.

SUMMARY OF THE INVENTION

A method and system is provided for identifying and detecting improperly wrapped envelopes for use in a mailpiece fabrication system. The method/system visually images each envelope in predetermined regions of interest to determine the spatial relationship between the internal content material and one or more points of reference indicative of the internal bounds of a sealing adhesive. By examining the spatial relationship, a determination is made regarding the proximity of the internal content material and the sealing adhesive. If the distance, or spatial separation, therebetween is below a threshold value, then an assumption is made that the content material and sealing adhesive are contiguous and that the envelope has been improperly sealed, i.e., with the content material interposing or otherwise inhibiting the proper closure of the wrapped envelope.

BRIEF DESCRIPTION OF THE DRAWINGS

The accompanying drawings illustrate presently preferred embodiments of the invention and, together with the general description given above and the detailed description given below serve to explain the principles of the invention. As shown throughout the drawings, like reference numerals designate like or corresponding parts.

DETAILED DESCRIPTION OF THE INVENTION

The present invention is directed to a system and method for identifying and detecting improperly wrapped envelopes for use in a mailpiece fabrication system. The method/system examines each envelope in predetermined regions of interest to determine the spatial relationship between the internal content material and one or more points of reference indicative of the internal bounds of a sealing adhesive. While the invention is described in the context of a paper-based wrapping system, i.e., a system which is fed by a paper web, for creating finished mailpieces, the invention is equally applicable to other mailpiece fabrication systems wherein adhesive is applied to a substrate material used to produce an envelope. Consequently, the detailed description and illustrations are merely indicative of an embodiment of the invention, and, accordingly, the invention should be broadly interpreted in accordance with the appended claims.

Figure 1:
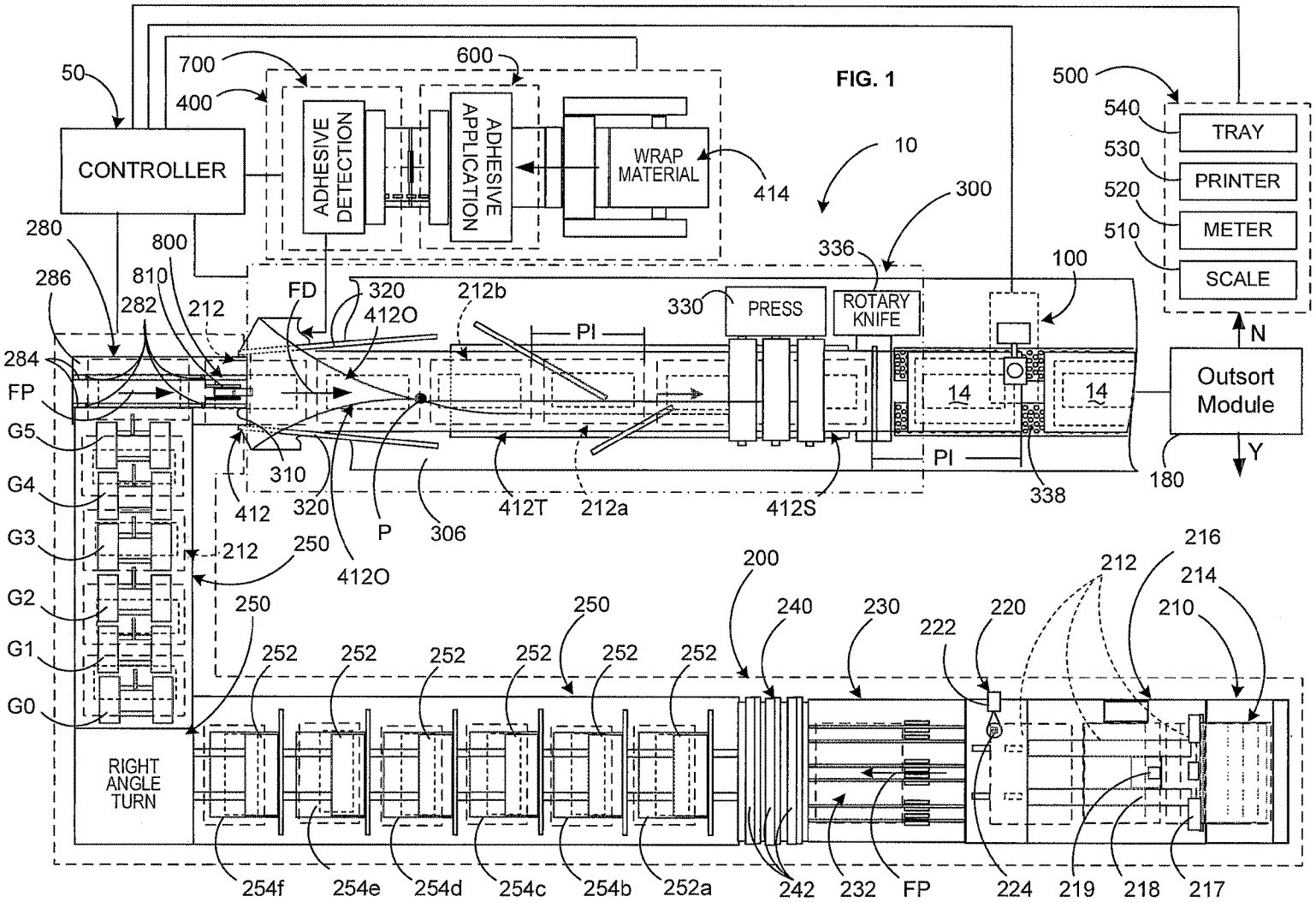
FIG. 1 is a schematic top view of a mailpiece fabrication system including content fabrication modules, wrapping material preparation modules including an adhesive application and detection system, a wrapping system, content material detection and position control modules and a plurality of finishing modules.
Figure 2:
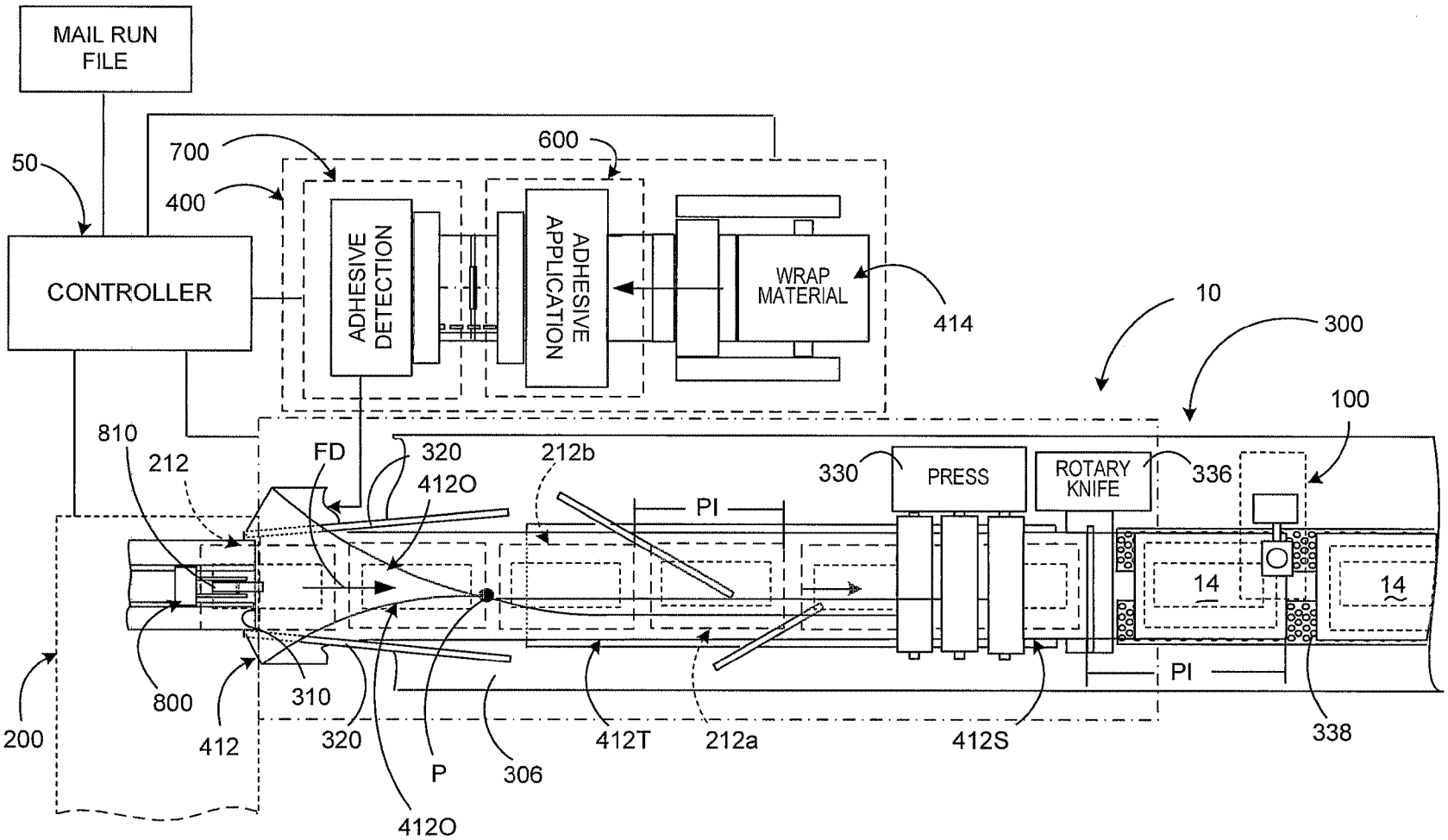
FIG. 2 is an enlarged schematic top view of the relevant portions of the mailpiece fabrication system according to the present invention including a wrapping system and a content material detection and position control system of the present invention.

Before discussing some of the more relevant details of the system and method of the present invention, a brief overview of a mailpiece fabrication system will be provided. FIGS. 1 and 2 depict a schematic block diagram of a mailpiece fabrication system 10 according to the present invention wherein: (i) a supply of content material 212 is produced by a variety of upstream content fabrication modules 200, (ii) a wrapping system 300 receives a supply of wrapping material 412, i.e., from a plurality of wrapping material preparation modules 400, and (iii) a plurality of finishing modules 500 complete the mailpiece fabrication process including weighing, metering and printing postage indicia on each wrapped envelope. Before the supply of wrapping material 412 is conveyed to the wrapping system 300, an adhesive application system 600 and adhesive detection system 700 prepare the substrate material 414 for being wrapped/sealed around the content material 212. More specifically, the adhesive application system 600 deposits a sealing adhesive 612 (see FIG. 3) about the periphery of the envelope 14 to wrap and enclose content material 212 therein.

The output of the wrapping system 300 is a series of wrapped envelopes 14 which, if properly wrapped, proceed to the finishing modules 500 where delivery data such as a mailpiece destination/return address is added. According to one embodiment of the invention, a content material detection system 100 is provided to examine the spatial relationship of the content material 212 to the sealing adhesive 612 to determine if the content material has been properly wrapped. According to another embodiment of the invention, a position control system 800 is provided to adaptively control the position of the content material 212 relative to the sealing adhesive 612 for the purpose of ensuring the efficacy of the peripheral seal and output efficiency of the wrapping system 300.

The overall operation of the mailpiece fabrication system 10 is coordinated, monitored and controlled by a system controller 50. While the mailpiece fabrication system 10 is described and illustrated as being controlled by a single system processor/controller 50, it should be appreciated that each of the modules 100-600 may be individually controlled by one or more processors. Hence, the system controller 50 may also be viewed being controlled by one or more individual microprocessors.

Upstream Content Fabrication Modules

In the described embodiment, the upstream content fabrication modules 200 include a feeder 210 containing a stack 214 of pre-printed sheets of content material 212. The pre-printed sheets of content material 212 are separated in the feeder 210 by a singulating apparatus 216 which uses a combination of guides 217, drive belts 218, and a stone roller 219 to retard the upper portion of the stack 212 while the lowermost sheet in the stack 212 is "singulated" or separated from the underside of the stack 212.

Next, the content material 212 is conveyed to a scanner 220 which reads information contained on select sheets of the content material 212 to provide mailpiece processing information to the controller 50. For example, a Beginning Of Collation (BOC) mark 222 may be read by a scanner 224 to indicate which sheet of content material 212, in a series of sheets being conveyed along a feed path FP, is the first sheet of a collation. These marks 222, also known as scan codes, are typically located in the margins of the content material 212 and are used to provide a myriad of information relating to the subsequent processing of the content material 212.

Scan codes 222 can provide information regarding whether a particular collation is to be folded, stitched, or stapled. Alternatively, a scan code can provide information regarding whether a particular mailpiece insert will be added to a particular sheet of content material 212 or to a collation of sheets of content material 212. Additionally, the scan code can provide information regarding the type of mailpiece being fabricated, i.e., whether the content material contains sensitive or confidential information. For example, some content material 212 may contain a recipient's social security number, credit card account information or private health information (protected under the HIPPA laws).

Once scanned, the sheets of content material 212 may then be grouped in an accumulator module 230 to produce a stacked collation of content material 212. A collation is typically produced by retarding the motion of select sheets in a pocket 232 of the accumulator module 230. Accordingly, the large stack of pre-printed sheets 212 which was singulated upstream by the feeder 210 may now be grouped together in smaller stacks to form one or more collations.

The content material 212, whether stacked into a collation or remaining as a single sheet, may be conveyed to a folding module 240 operative to fold the content material into a particular fold configuration. More specifically, the folding module 240 manipulates the content material around a plurality of press rollers 242 to produce various fold configurations, e.g., a bi-fold, C-fold, Z-fold or gate-fold configuration. Depending upon the processing information obtained from the scan codes 222, the fold module 240 may introduce a fold configuration into the content material 212 or pass the content material 212 unaffected to a chassis module 250.

The chassis module 250 performs one of the more important functions of the content fabrication modules 200 inasmuch a variety of additional information can be added to the content material 212 by way of mailpiece inserts 252, e.g., coupons, advertisements, solicitations, etc. Therein, a mailpiece insert 252 may be added by one of a series of overhead feeders 254*a*, 254*b*, 254*c*, 254*f*, 254*e*, 254*f*, and dropped onto a select piece of content material 212 as it passes beneath the overhead feeders 254*a*, 254*b*, 254*c*, 254*f*, 254*e*, 254*f*. Inasmuch as the system controller 50 knows the specific processing requirements and location of each piece of content material 212, i.e., location along the feed path, the overhead feeders 254*a*, 254*b*, 254*c*, 254*f*, 254*e*, 254*f* may selectively add inserts to build the content material 212 for a particular mailpiece recipient. For example, a specific advertisement, targeted to one mailpiece recipient, may be added by one of the feeders 254*a*, 254*b*, 254*c*, 254*f*, 254*e*, 254, while a coupon offering may be added to the content material 212 of another mailpiece recipient by another of the feeders 254*a*, 254*b*, 254*c*, 254*f*, 254*e*, 254*f*.

The content material 212 is then passed to a buffer module 270 through a right angle turn module (RAT) 260. Depending upon the space available for the various upstream content fabrication modules 200, the RAT 260 may, or may not, be required. The buffer module 270, on the other hand, performs another one of the more critical operations inasmuch as it serves as the "traffic manager" for the mailpiece fabrication system 10. More specifically, the buffer module 270 employs one (1) in-feed buffer gate G0 and five (5) buffer gates G1-G5 to coordinate the timing of the content material 212 from the chassis module 250 to the wrapping system 300. Such coordination is necessary to eliminate gaps or "dry-holes" when delivering content material 212 to the wrapping system 300.

In operation, the buffer module 270 receives input from the controller 50 regarding the flow of content material 212 from the chassis module 250 and determines the requisite speed of the wrapping system 300 to ensure that the supply of content material 212 is smooth and uninterrupted. Based upon the anticipated acceleration of the wrapping system 300, the controller invokes various algorithms to ensure that the wrapping system 300 is not exposed to accelerations which may rupture, tear or fail the supply of wrapping material 412. As a result reliability and throughput of the mailpiece fabrication system 10 is optimized.

In addition to optimizing throughput, the buffer module 270 ensures that content material 212 is properly "matched" with a supply of pre-printed wrapping material 312 and the resulting wrapped envelope contains the content material for which it was intended.

From the buffer module 270, the content material is passed to an input conveyor 280 at a right-angle for delivery to the wrapping system 300. The input conveyor 280 is conventional in its construction and includes pairs of drive fingers 282 which are driven by belts (also not shown) through elongate slots 284 in a transport deck 286. The drive fingers 282 engage a trailing edge of the content material 212 to convey the content material along the deck 285. To prevent the sudden impact of the fingers 282 from disrupting the registration of the content material 212, the input conveyor 280 includes a pair of drive rollers (not shown) to accelerate the content material 212 before being acted on by the drive fingers 282. That is, the drive rollers are operative to accelerate the content material 212 such that the drive fingers 282 engage the trailing edge at nearly the same speed/velocity as the content material 212. As such, a smooth transition occurs to prevent misalignment of the content material 212, e.g., a collation of sheets including one or more inserts, upon changing direction and velocity.

The content material 212 is then conveyed downstream to a phase nip roller assembly 810, which according to the present invention, is a component of the position control system 800, and functions to deliver the content material 212 to the wrapping system 300. More specifically, the phase nip roller 810 centers and matches the velocity of the content material 212 relative to the supply of wrapping material 412. It should be appreciated that the delivery of content material 212 from the content fabrication modules 200 to the wrapping system 300 is a critical to the workings of the mailpiece fabrication system 10. The control and timing thereof is discussed in greater detail below in a section entitled "Content Material Detection and Position Control Systems".

Mailpiece Envelope System

In FIG. 2, the wrapping system 300 receives content material from the input conveyor 280 and phase nip roller 810 of the position control system 800. Furthermore, the wrapping system 300 receives wrapping material 412 from the wrapping material preparation modules 400. With respect to the latter, prepared wrapping material 412 is fed to an upper conveyance deck 306 of the wrapping system 300 from a series of rollers 308 disposed beneath the deck 306. By "prepared" is meant that the wrapping material 300 may have address or advertisement information pre-printed on a face of the wrapping material. Furthermore, the wrapping material 300 may pre-cut to a particular envelope configuration, i.e., including windows for viewing internal information printed on the wrapped content material, and/or have adhesive deposited in select areas.

The wrapping material 412 is drawn vertically upward (i.e., normal to the plane of the conveyance deck 306), across an upstream edge 310 of the deck 306 and horizontally downstream, i.e., in the direction of arrow FD, along the surface of the conveyance deck 306. As the wrapping material 412 is drawn over the upstream edge 310, the outboard edge portions 412O of the wrapping material 412 are pulled across a pair of guide rods 320 such that the outboard edge portions 412O converge at a point P and overlap. As such, the wrapping material 412 produces an "open-end" for accepting the content material 212 from the phase nip roller 810. Furthermore, a tube-shaped wrap 412T is formed around the content material 212 as the wrapping material 412 is drawn together downstream of the open-end.

In the described embodiment, several pieces of content material 212 have been laid into the open end of the tube-shaped wrapping material 412T and spaced-apart by a pitch distance PI, i.e., the distance from the leading edge of one piece of content material 212*a* to the leading edge of the subsequent piece of content material 212*b*. Once wrapped, the tube-shaped wrapping material 412T is compressed by a triage of press rollers 330 to produce a strip 412S of sealed mailpiece envelopes. The strip 414S of sealed mailpiece envelopes is then is cut to produce individual wrapped envelopes 14 by a rotary cutter 336.

Thereafter, each of the wrapped envelopes 14 is transported from the rotary cutter 336 on a vacuum deck 338 which is controlled to separate each wrapped envelope 14 by a predetermined separation distance. Once again, the distance between successive leading edges is the pitch distance PI of the wrapped envelopes 14.

Wrapping Material Preparation Module (Adhesive Application and Detection)

In FIG. 2, the supply of wrapping material 412 is prepared as a flat-pattern substrate which is rolled into a web of substrate material 414. The flat pattern substrate may include pre-printed information such as recipient and sender address information (not shown) or may be pre-cut to include windows (also not shown) for viewing mailpiece address information printed on the content material 212.

In the described embodiment, the substrate material 414 is conveyed over a series of re-directing rollers 308 which direct the substrate material 414 downwardly passed an adhesive application system 600 and upwardly toward the deck 306 (see FIG. 1) of the wrapping system 300. The adhesive application system 600 includes a bank of application nozzles 610 for depositing a thin line/film of adhesive 612 on the substrate material 414 as it moves passed each of the nozzles 610. A supply of the adhesive 612 is contained in a pressure vessel 616 for feeding each of the application nozzles 610. The vessel 616 is heated to a temperature of about two hundred degrees Fahrenheit (200° F.) by a conventional electric heating element 618 and pressurized to an internal pressure of about between about thirty to ninety PSI (30-90 $lb/in^2$) by a hydraulic pump 620.

Additionally, the application nozzles 610 are mounted to a carriage assembly 626 which moves toward or away from the substrate material 414 in the direction of arrows NM by a linear actuator 628. More specifically, the application nozzles 610 are mounted to cross-member 632 bearing mounted to a pair of guide rails 636. Furthermore, the guide rails 636 are orthogonal to and disposed beneath the re-directing rollers 308.

Each time the wrapping system 300 demands a supply of wrapping material 412, the linear actuator 628 moves the bank of application nozzles 610 toward the substrate material 414 to deposit adhesive 612. The deposition of adhesive can be as straightforward as depositing a line of a predetermined thickness on the substrate material 414 as the substrate is conveyed across the head of each nozzles 610. Generally, the lines of adhesive 612 run parallel or orthogonal to the feed path FP of the substrate material 414. The gaps or breaks in the lines of adhesive 612 are predefined by the mail run data, i.e., the file containing mailpiece fabrication data, and made to effect a particular seal configuration when the wrapping material 414 is folded and cut by the wrapping system 300. Consequently, the gaps and breaks are fixed, i.e., the spacing therebetween are generally constant.

Notwithstanding the conventional manner for depositing adhesive 612, commonly owned, co-pending patent application entitled "Adaptive Adhesive Application (AAA) System", discloses an adhesive application system 100 which is variable to improve reliability and reduce the maintenance required in connection with the wrapping system 300 and other modules 100-800. More specifically, in the co-pending AAA System, the inventors discovered that by selectively controlling the nozzles 610, and the process for depositing the adhesive, cross-contamination to other modules, e.g., the rotary cutter 336, can be significantly reduced.

Irrespective the requirement to control the flow of adhesive as described in the preceding paragraph, there is still a need to determine if the adhesive has been properly applied. For example, should the lack of adhesive prevent closure of the envelope, there is a chance that hundreds of envelopes 14 may be improperly sealed. While the lack of forming a proper enclosure may be relatively inconsequential for some envelopes 14, for others containing confidential information, e.g., a social security number, credit card number or bank account information, the legal liabilities can be significant for the mailer.

Figure 3:
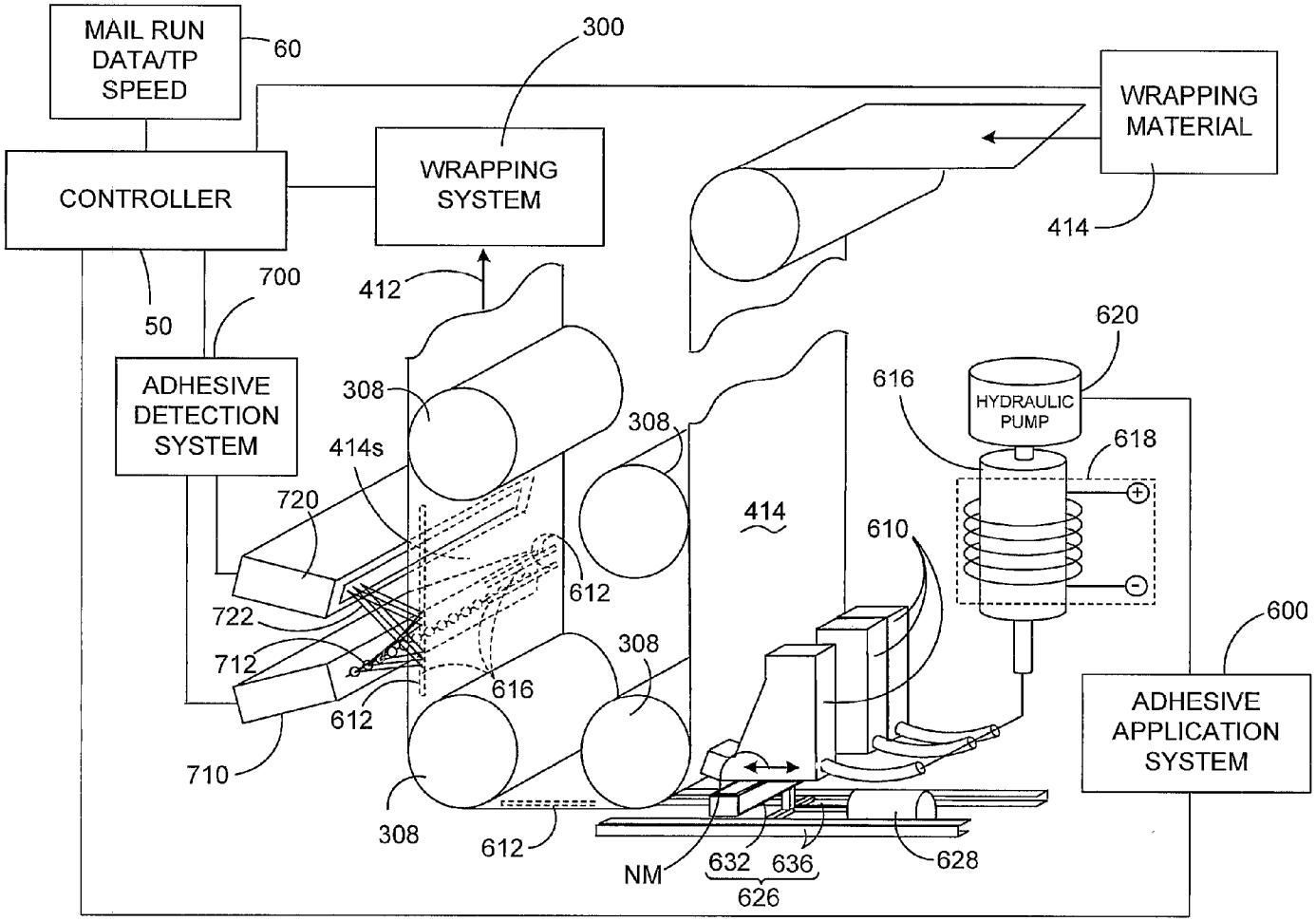
FIG. 3 is a broken-away perspective view of an adhesive application and detection system disposed on opposing surfaces of a mailpiece wrapping material.

In the described embodiment and referring to FIGS. 2 and 3, an adhesive detection system 700 determines whether the adhesive 612 was: (i) applied to the substrate material 414, (ii) applied at the proper location, and/or (iii) was applied in the proper quantity. The system 700 comprises a source 110 of ElectroMagnetic (EM) energy 712, in at least the short UV range, to illuminate the surface 414*s* of the substrate material 414, i.e., select regions 616 where the adhesive 612 is anticipated to be deposited. A source of EM energy 712 suitable for irradiating the surface 414*s* with UV light may be a short UV Light Emitting Diode (LED) or series short UV LEDs. Furthermore, a fluorescent UVC germicidal lamp may be used to illuminate the substrate 414. Any known illumination can be used, such as, UV lasers, as long as they emit EM energy in the short UV range. By "short UV" range means between one-hundred (100 nm) to about three-hundred nanometers (300 nm). Preferably still, a short UV range means between two-hundred forty nanometers (240 nm) to about two-hundred eighty nanometers (280 nm).

The wrapping material or substrate 414 is a conventional fiber reinforced, resin impregnated white paper which, when irradiated with short UVC energy, emits or fluoresces EM energy in the visible light range (i.e., a higher wavelength) of between about four-hundred nanometers (400 nm) to eight hundred nanometers (800 nm). While the wrapping material 414 emits energy in the visible light range when irradiated with short UVC energy, the polymeric adhesive 612 absorbs the most or all of the UVC energy. Consequently, the polymeric adhesive 612 can be viewed as blocking the UV energy from reaching the underlying substrate material 414.

Additionally, the system 700 includes an EM energy detection device 720 operative to detect energy 722 reflected from the surface 414*s* of the substrate material 414 in the visible light range of between about four-hundred nanometers (400 nm) to eight hundred nanometers (800 nm). An EM detection device 720 suitable for practicing the invention includes a light-to-voltage sensor used to collect the light emitted from the substrate 414 and convert the light to an analog voltage. Any other energy detection methods can be used such as, a photocathode or a CCD/Vision system.

Figure 4:
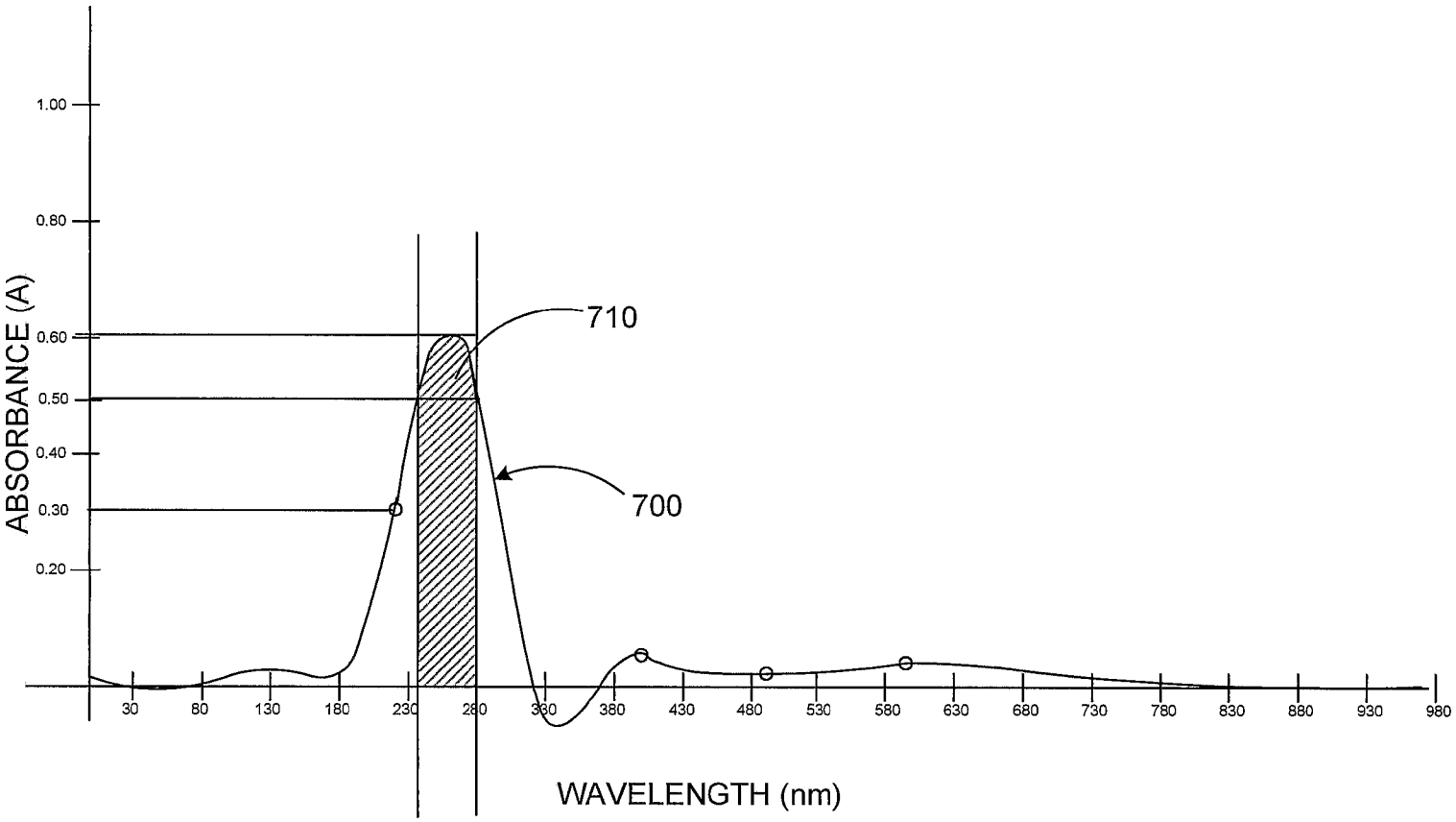
FIG. 4 is a graphical depiction of the absorbance of a polymer adhesive as a function of wavelength from zero to one-thousand nanometers (0 nm-1000 nm) in wavelength.

FIG. 4 depicts a graph 750 of the optical absorbance of the polymer adhesive 612, i.e., the response detected by the EM detection device 720, as a function of wavelength. The cross-hatched area 760 under curve reveals the absorbance of the polymeric adhesive 612 in the short UV range. In the described embodiment, the amplitude of the response reaches a maximum value of about 0.6 on a scale of energy absorbance with an adhesive film thickness of 0.05 mm using a Perkin Elmer Lambda 900 Spectrophotometer.

The system controller 50, or a processor dedicated to the adhesive detection system 700, is operative to analyze the response of the EM energy detection device 720. The detection system 720 determines when the EM energy 750 emitted is below a threshold level signaling the absorbance of energy by the adhesive 612. The threshold level will generally be determined by a calibration step at system start-up, however, in the described embodiment, a threshold level of about 0.5 may be suitable for detecting the presence of adhesive on the substrate material 414.

To facilitate detection, optical brighteners are often incorporated, or can be added, into the substrate material 414 such that the combined effect augments the effectiveness of the adhesive detection system 700. More specifically, such brighteners increase the signal that the EM detection device 720 receives. The Perkin Elmer Lambda 900, is equipped with an integrating sphere to collect all light from the sample.

Content Material Detection and Position Control Systems

Figure 5:
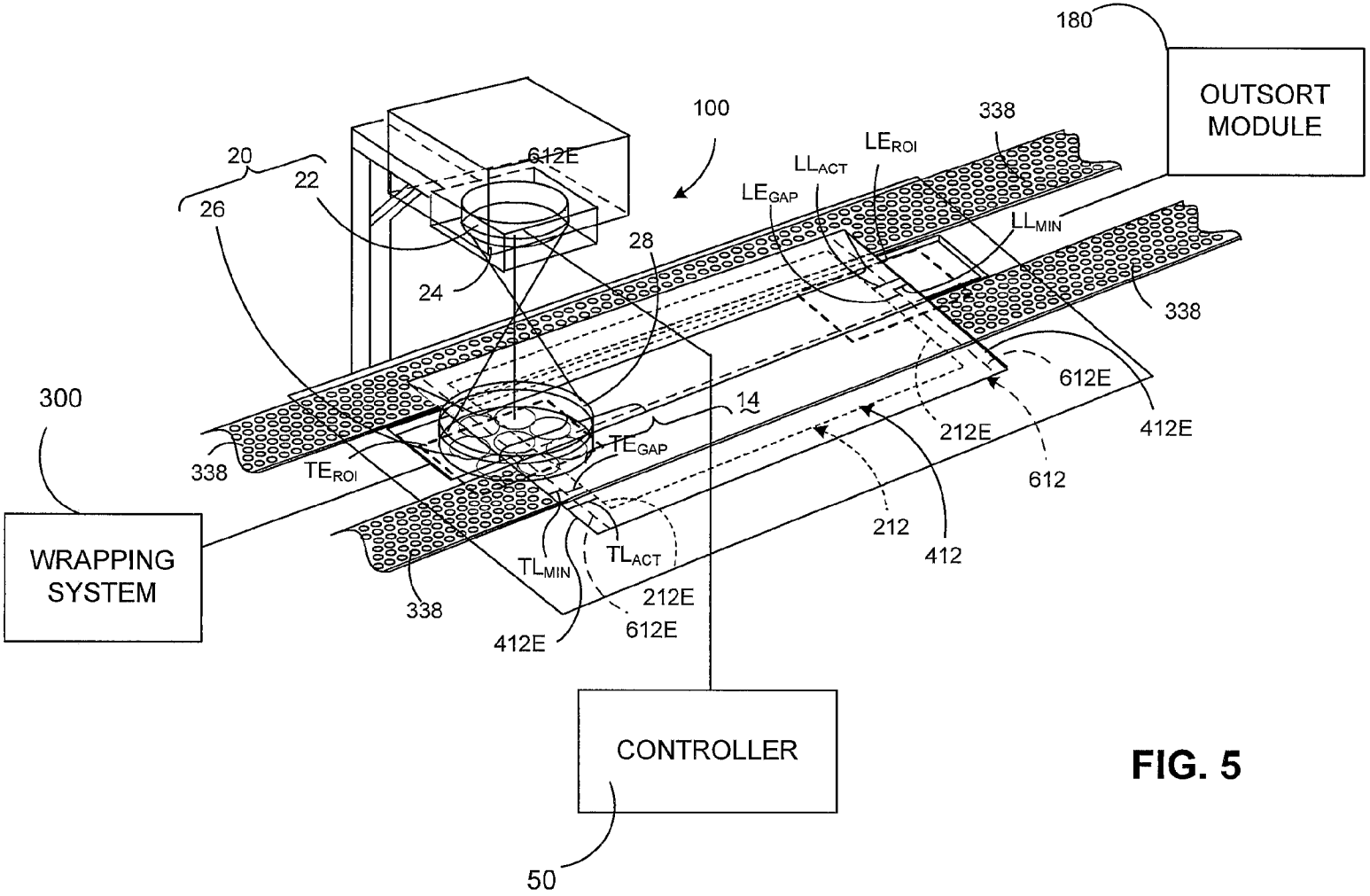
FIG. 5 is a broken-away perspective view of the content material detection system according one embodiment of the invention an optical imaging system for determining the spatial relationship of the content material relative to the overlying wrapping material.

In addition to a system 700 which detects the presence, location and quantity of adhesive 612 on the substrate material 414, the present invention monitors the efficacy, reliability and output of the wrapping system. In FIG. 5, a content material detection system 100 is provided comprising an imaging device 20 for optically imaging each of the wrapped envelopes 14 to determine the spatial relationship between the internal content material 414 and one or more points of reference indicative of the internal bounds of the sealing adhesive 612, a means for providing a cue when the spatial separation between the content material 414E and the point of reference 612E is less than a threshold value.

More specifically, the optical imaging system 20 includes a camera system 22 disposed on one side of a wrapped envelope 14 and a light source 26 disposed on the other side of the wrapped envelope 14. The camera system 33 captures two images of each wrapped envelope 14 while the envelope 14 is in motion. The two captured images are shown in FIG. 3 as the leading edge and trailing edge regions of interest $LE_{ROI}$ and $TE_{ROI}$, respectively. The displacement of individual envelopes 14 are tracked along the feed path FP using conventional photocell event/encoder based means (not shown) enabling both images to be captured at the proper envelope locations to provide the two desired leading and trailing edge regions of interest, $LE_{ROI}$, $TE_{ROI}$. The exposure time for each image is sufficiently small to provide a clear, non-blurred image of the moving envelope 14. Ideally, each leading edge and trailing edge regions of interest $LE_{ROI}$ and $TE_{ROI}$, contains a cut envelope edge 212E and a content material edge 412E, with margin on either side.

The light source 26 is sufficiently bright to transmit sufficient light energy to transmit across or though two thicknesses of the wrap material 412 so that the camera system 22 can detect the transmitted light energy. An optical diffuser 28 may be employed over the light source 26 to produce more uniform light before passing through the envelope 14. Additionally, the light source 26 is sufficiently bright to enable the use of a suitably high lens "f-stop", thereby providing an acceptable depth of field for envelopes of variable thickness. In a preferred embodiment, the light source 26 is strobed with the exposure of the camera 22, to allow a higher illumination intensity to transmit through variable envelope thicknesses. Within the region of interest (ROI), the content material 212 will decrease the amount of light transmitted such that the content material 212 will appear darker than the surrounding area, i.e., where the thickness of the wrapping material 414 is only two sheets in thickness.

Once the camera 26 captures and stores an image (i.e., commonly referred to as frame grabbing), conventional edge detection algorithms process the digital image data. In the described embodiment, the algorithms determine the edge location of the content material 212E, the edge location of the envelope 412E (indicative of the edge location of the sealing adhesive 612E) and the separation distance therebetween. Examples of these separation distances are shown in FIG. 3 as dimensions $LE_{GAP}$ and $TE_{GAP}$. More specifically, the separation distance $LE_{GAP}$, $TE_{GAP}$ may be viewed as the difference between an actual value $LL_{ACT}$, $TL_{ACT}$ indicative of the edge location of the content material and a predefined reference value $LL_{MIN}$, $TL_{MIN}$ indicative of the edge location the sealing adhesive. While the described embodiment uses an indirect point of reference, i.e., the edge location of the wrapped envelope. to define the location of the sealing adhesive, it should be appreciated that the location of the sealing adhesive may be used directly, to the extent that the imaging device 22 has the imaging power or resolution to do so.

As mentioned in the preceding paragraph, the values for $LL_{MIN}$, $TL_{MIN}$ are predetermined for each mail run job and correspond to the distance between the envelope edge 414E and the inboard edge of the respective adhesive strip, i.e., glue line, If either $LE_{GAP}$, or $TE_{GAP}$, is less than the $LL_{MIN}$ or $TL_{MIN}$, then the content material 212 either touches or interposes the sealing adhesive 612. When the processor 50 determines that the spatial relationship does not meet certain predefined criteria, e.g., that the separation distance is below a threshold value, then a determination is made that the envelope 14 has not been properly wrapped. As a consequence, the envelope 14 is rejected and diverted from the feed path by an outsort module 180.

The edge detection algorithms must measure and determine the relative positions of the content material 212E relative to the predefined references associated with the wrapping material of the envelope 412E and/or the sealing adhesive 612E within a short period of time. That is, when the mailpiece fabrication system operates at full capacity, the content and wrapping materials 212, 414 travels at a rapid 70 cm/sec. While conventional edge detection algorithms can perform the requisite analysis and calculations within the available time period, the inventors learned that the use of certain security features know as "obfuscation patterns", present additional challenges for the content material detection system of the present invention. In the context used herein, obfuscation patterns refer to security features printed on the inside surface of a mailpiece to prevent the human eye from reading/viewing any internal print/images internal to the mailpiece.

Inasmuch as typical obfuscation patterns absorb light in the visible spectrum to prevent viewing by a human eye, these patterns are far less effective in the near-infrared region of the electromagnetic (EM) spectrum above about 920 nm in wavelength. To facilitate the continued use of conventional obfuscation patterns on wrapping material, the preferred embodiment employs a light source 26 which emits electromagnetic energy at above about nine-hundred and twenty nanometers (920 nm) in wavelength and a long band-pass filter 24 which is compatible with the light source 28 over the lens of the camera 22 of the optical imaging device 20 nm.

Figure 5A:
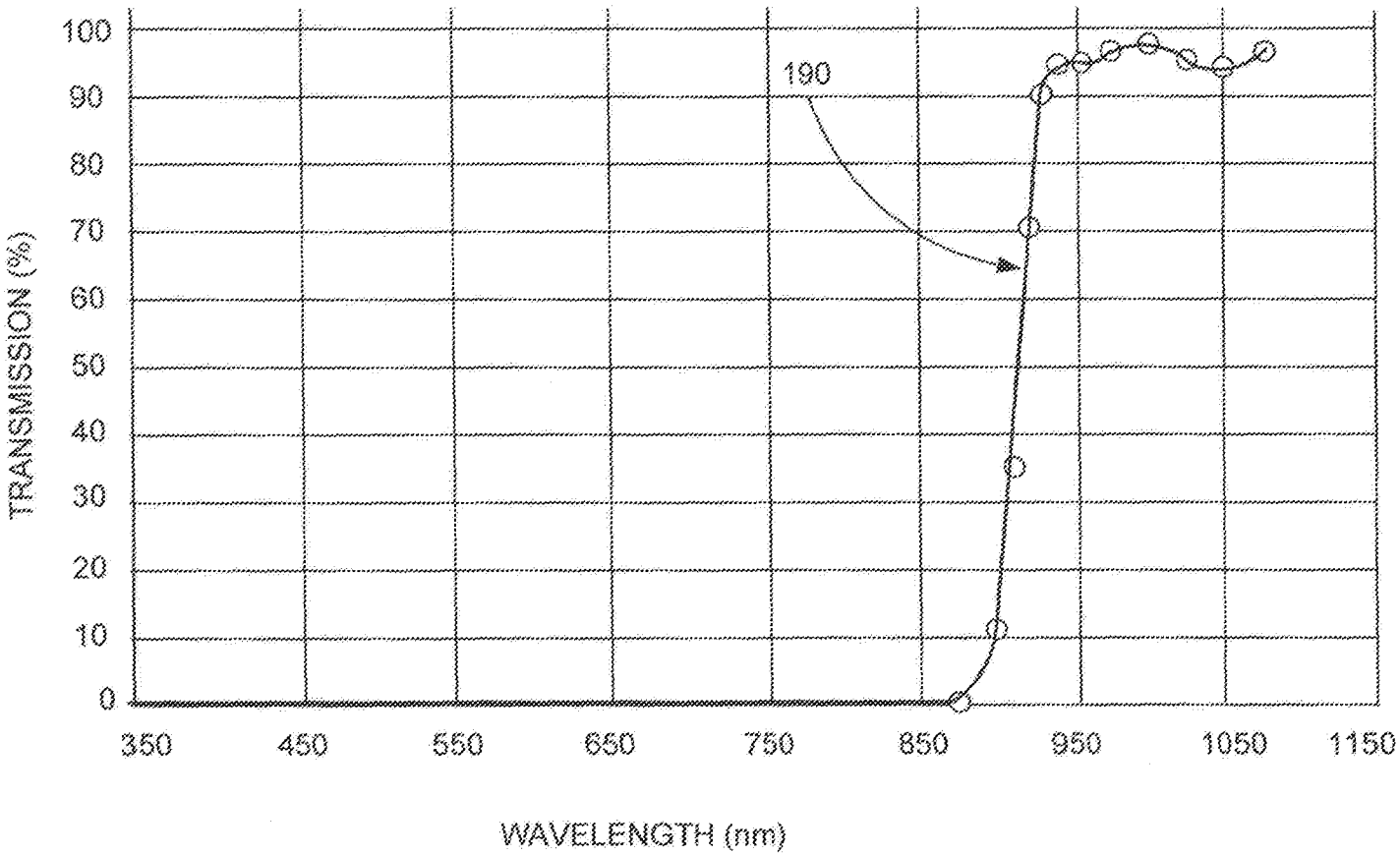
FIG. 5*a* is a graphical depiction of the transmission characteristics (i.e., the percent transmission vs. wavelength in nanometers (nm)) of a high pass filter used in conjunction with the optical imaging system of the content material detection system.

FIG. 5*a* depicts a graph 190 of the optical characteristics of the long band-pass filler 24 wherein the filter 24 transmits ninety percent (90%) of the light energy in the region of the electromagnetic spectrum above about nine-hundred and twenty nanometers (920 nm) in wavelength and suppresses ninety-nine percent (99%) of the light energy below about eight hundred and fifty nanometers (850 nm) in wavelength. The use of these properties in connection with the optical imaging system 20 renders most obfuscation patterns ineffective and enhances the reliability of the inventive content material detection system 100.

Another benefit to the use of this wavelength relates to the elimination of eye irritation which may be caused by strobing the high intensity light source 26. Additionally, the use of an infra-red light source 26 and long band-pass filter 24 prevents the imaging system 20 from detecting print on the outside surface of the wrapping material 412 and being mistakenly identified as an edge, i.e., of either the content or wrapping materials 212, 412.

Figure 6:
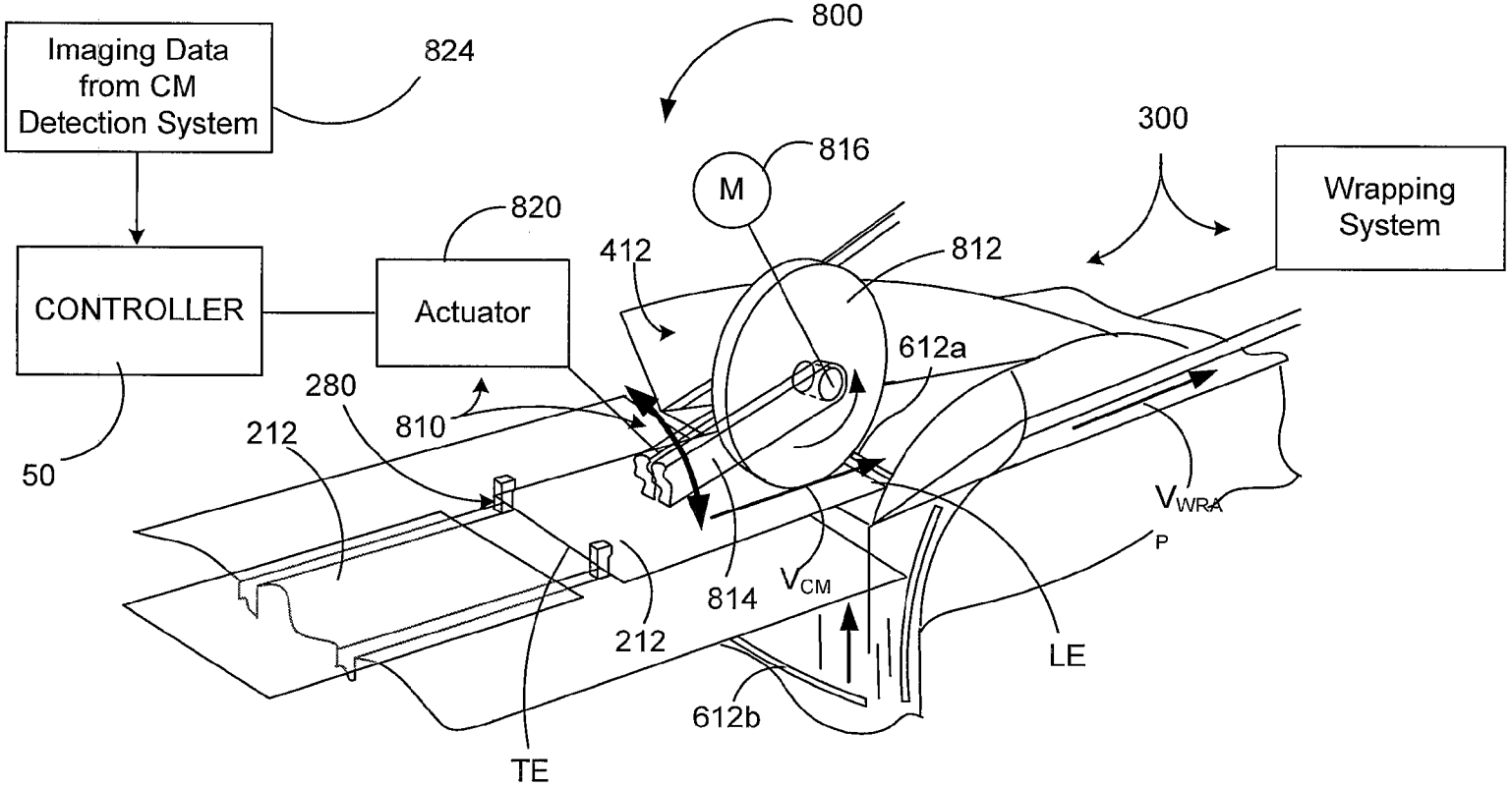
FIG. 6 is a broken-away perspective view of the content material detection system according to another embodiment of the invention which employs feedback from the content material detection system to incrementally adjust the longitudinal position of the content material relative to the wrapping material.

The detection system 100 may also be used in conjunction with the position control assembly 800 and used to dynamically adjust the phasing relationship between the collation 212 and the wrapping material 412. In FIG. 6, the content material 212 is merged with the wrapping material 412 at the open end of the tube-shaped wrap 412T while under the positional control of the phase nip roller assembly 810. As the content material 212 approaches the wrapping system 300, it is travelling at a higher velocity than the wrapping material 412. The phase nip roller assembly 810 includes a drive roller 812 rotationally mounted to a pivot arm assembly 814 capable of rotational movement in the direction of arrows PA. Furthermore, the drive roller 812 is centered within the open end 412O of the wrapping material 412. The roller 812 (i) receives the content material 212 from the upstream conveyor 280, (ii) drives each piece of content material 212 into one of a series of content material stations, i.e., each station defined by and between the sealing adhesive 612*a*, 612*b*, and (iii) matches the velocity of content material 212 with the that of the wrapping material 412. The phase nip roller 812 maintains control of the content material 212 by releasing the trailing edge of the content material 212 into one of the content material stations. More specifically, a drive motor 816 drives the roller 812 in a counter-clockwise direction while a linear actuator 820 releasably applies a downward force to effect engagement and release of the content material 212 into the open end 412O of the wrapping system 300. While the drive motor 816 may drive the roller 812 using any one of a variety of drive mechanisms, in the described embodiment, the roller 812 is driven by one or more drive belts (not shown) which wrap around the drive shaft of the roller 812.

Phasing between the content material 212 and the wrapping material 412 is presently set with a job parameter. By "phasing" is mean the timing and delivery of the content material 212 into the open end of the wrapping material 412 such that the content material is generally centered between successive strips of adhesive 612*a*, 612*b* and/or the envelope edges LE, TE which are cut downstream by the rotary cutter 336. This predefined position data is typically determined during set up of a specific job run using a trial and error method. After a mail run job is started, there are a number of matters that can cause the content material 212 to drift from a centered location inside the tube shaped wrapping material 412T. These include imperfect set of the job run, paper slippage at higher speeds, and elongation of the wrapping material 412 under high tensile loads.

The position control system 800, therefore analyzes the output of the content material detection system 100, i.e., comparing the image data to the set of predefined position data, to produce a phase nip correction signal. The correction signal is used by the phase nip roller assembly 810 to adaptively adjust the position of the content material 212 by incrementally adjusting the he phase-nip roller assembly.

The output of the leading and trailing edge gap values, $LE_{GAP}$, $TE_{GAP}$ can be processed during machine runtime to fine tune the location/placement of the content material 212 to correct for content material 212 drift while still providing the outsort capability for envelopes that fall below one of the threshold values. For example in one implementation of the method, the use of a moving average of the leading and trailing edge gap values, $LE_{GAP}$, $TE_{GAP}$, may be employed. After a first number of envelopes n, of a job run, the moving averages of the leading and trailing edge gap values, $LE_{GAP}$, $TE_{GAP}$ are computed. The number n, can be any value, e.g., one-hundred (100) envelopes where increasing the number will reduce the rate of change of the averages. Based on the moving averages, the phase parameter can be corrected by a small amount. Thereafter, a new moving average is computed for each envelope and the phase nip correction value can be computed as follows:

$$\text{LE Moving Average}(\text{LE Gap1}+\text{LE Gap2}+\text{LE Gap3}+\ldots\text{LE Gap}n)/n \quad \text{(Eq. 1)}$$

$$\text{TE Moving Average}=(\text{TE Gap1}+\text{TE Gap2}+\text{TE Gap3}+\ldots\text{TE Gap}n)/n \quad \text{(Eq. 2)}$$

$$\text{Phase Nip Correction Value}=(\text{LE Moving Average})-(\text{TE Moving Average}) \quad \text{(Eq. 3)}$$

Therefore as the content material 212 shifts downstream during a job fun the LE Moving Average will decrease and the TE Moving Average will increase. This results in a negative Phase Nip Correction Value, thereby shifting the content material 212 upstream with respect to the wrapping material 412, in a direction towards the nominal center of the tube-shaped wrap 412T. Similarly, as the content material 212 shifts upstream during a job, the Phase Nip Correction Value will become positive and will also shift the content material 212 towards the center of the wrapping material.

Since this method always effects a shift of the content material 212 towards the center of the tube-shaped wrap 412T, the threshold values of $LL_{MIN}$ and $TL_{MIN}$ can still be used as threshold values for outsorting envelopes that are considered to have poor content material 212 placement. When the actual $LE_{GAP}$ and $TE_{GAP}$ values are less than these threshold values, i.e., $LL_{MIN}$ and $TL_{MIN}$, it is preferred to discard them for use in the moving average calculations (Equations 1 and 2), as they fall outside the scope of acceptable envelopes 14 and should not adversely effect proper content material 212 placement.

Finishing Modules

Once the individual wrapped envelopes 14 are cut, the mailpieces are completed by a series of finishing modules 500. The finishing modules may, inter alia, include a scale 510, a meter 520, a printer 520 and a tray or bin 530 for collecting the mailpieces. The scale 510 determines the weight of each mailpiece, but may also include a scanner to determine the size/volume of the mailpiece. Once the size/weight of the mailpiece has been determined a postage meter determines the postage required for delivery of the mailpiece. The printer 530 applies the postage indicia to the mailpiece and any other mailpiece information which may be required, e.g., destination and/or return address information. Finally, the mailpieces may be accumulated in a tray or bin for ease of delivery.

It is to be understood that all of the present figures, and the accompanying narrative discussions of preferred embodiments, do not purport to be completely rigorous treatments of the methods and systems under consideration. For example, while the invention describes an interval of time for completing a phase of sorting operations, it should be appreciated that the processing time may differ. A person skilled in the art will understand that the steps of the present application represent general cause-and-effect relationships that do not exclude intermediate interactions of various types, and will further understand that the various structures and mechanisms described in this application can be implemented by a variety of different combinations of hardware and software, methods of escorting and storing individual mailpieces and in various configurations which need not be further elaborated herein.

The invention claimed is:

1. A method for detecting an improperly wrapped envelope in a mailpiece fabrication system, each envelope comprising content material disposed internally of a wrapping material forming a sealed enclosure by a sealing adhesive, disposed around, at least a portion of, the content material, the method comprising the steps of:

optically imaging each wrapped and sealed envelope in predetermined regions of interest to examine a spatial relationship between the internal content material and a point of reference indicative of the internal bounds of the sealing adhesive; and examining a proximity of the internal content material and the point of reference indicative of the internal bounds of the sealing adhesive and providing a cue when the spatial separation therebetween is less than a threshold value.

2. The method according to claim 1 wherein the step of providing a cue includes the step of identifying the wrapped envelope corresponding to the cue, and further comprising the steps of:

conveying wrapped envelopes to at least one finishing module; and out-sorting any wrapped envelopes identified by the cue.

3. The method according to claim 1 wherein the step of optically imaging each wrapped envelope includes the steps of: providing a light source disposed on one side of the wrapped envelope and providing a light imaging camera on the opposite side of the envelope to receive light transmitted through the wrapped envelope.

4. The method according to claim 1 wherein the step of optically imaging each wrapped envelope includes the steps of:

capturing two images of each wrapped envelope at a Leading Edge (LE) Region of interest (ROI) and a Trailing Edge (TE) Region of Interest (ROI).

5. The method according to claim 4 wherein the LE ROI is proximal to a leading edge of the wrapped envelope and includes a portion of a cut leading edge and a leading edge portion of the content material, and wherein the TE ROI is proximal to a trailing edge of the wrapped envelope and includes a portion of a cut trailing edge and a trailing edge portion of the content material.

6. The method according to claim 4 wherein the LE ROI includes a portion of the sealing adhesive disposed along a leading edge of the wrapped envelope and a leading edge portion of the content material, and wherein the TE ROI includes a portion of the sealing adhesive disposed along a trailing edge of the wrapped envelope and a trailing edge portion of the content material.

7. The method according to claim 3 wherein the step of providing a light source further comprises the step of strobing in time the light source with the light imaging camera.

8. The method according to claim 4 wherein the step of providing a light source further comprises the steps of:

illuminating the wrapped envelope with electromagnetic energy above about nine hundred and twenty nanometers (920 nm) in wavelength, and filtering the light energy received by the optical camera by a long band-pass filter which transmits at least ninety percent (90%) of the electromagnetic energy having a wavelength equal to or greater than about nine-hundred and twenty nanometers (920 nm).

9. The method according to claim 8 wherein the step of filtering the light energy includes the step of suppressing up to ninety-nine (99%) of the electromagnetic energy below a wavelength of about nine-hundred and twenty nanometers (920 nm).

10. A system for detecting an improperly wrapped envelope in a mailpiece fabrication system, each envelope comprising content material disposed internally of a wrapping material forming a sealed enclosure by a sealing adhesive, disposed around, at least a portion of, the content material, the system for detecting an improperly wrapped envelope comprising:

an imaging device for optically imaging wrapped and sealed envelopes capturing imaging data in predetermined regions of interest to determine a spatial relationship between the internal content material and one or more points of reference indicative of the internal bounds of the sealing adhesive, and a processor, in communication with the imaging device, and operative to examine a proximity of the internal content material and the one or more points of reference indicative of the internal bounds of the sealing adhesive and providing an error signal when the spatial relationship therebetween is less than a threshold value, thereby identifying an envelope which is improperly wrapped based upon the imaging data.

11. The system for detecting an improperly wrapped envelope according to claim 10 wherein the processor tracks the location of each piece of content material processed by the system, and further comprising a means for out-sorting the identified envelope.

12. The system for detecting an improperly wrapped envelope according to claim 10 wherein the optical imaging device includes a light source disposed on one side of the wrapped envelope and a light imaging camera on the opposite side of the wrapped envelope to receive light transmitted through the wrapped envelope.

13. The system for detecting an improperly wrapped envelope according to claim 12 wherein the optical imaging device captures two images of each wrapped envelope at a Leading Edge (LE) Region of Interest (ROI) and a Trailing Edge (TE) Region of interest (ROI).

14. The system for detecting an improperly wrapped envelope according to claim 13 wherein the LE ROI is proximal to a leading edge of the wrapped envelope and includes a portion of a cut leading edge and a leading edge portion of the content material, and wherein the TE ROI is proximal to a trailing edge of the wrapped envelope and includes a portion of a cut trailing edge and a trailing edge portion of the content material.

15. The system for detecting an improperly wrapped envelope according to claim 13 wherein the LE ROI includes a portion of the sealing adhesive disposed along a leading edge of the wrapped envelope and a leading edge portion of the content material, and wherein the TE ROI includes a portion of the sealing adhesive disposed along a trailing edge of the wrapped envelope and a trailing edge portion of the content material.

16. The system for detecting an improperly wrapped envelope according to claim 12 wherein the light source is strobed in time with the fight imaging camera.

17. The system for detecting an improperly wrapped envelope according to claim 12 wherein the light source illuminates the wrapped envelope with electromagnetic energy above about nine-hundred and twenty nanometers (920 nm) in wavelength and further comprising a long band-pass filter which transmits at least ninety percent (90%) of the electromagnetic energy having a wavelength above about nine-hundred and twenty nanometers (920 nm).

18. The system for detecting an improperly wrapped envelope according to claim 10 wherein the optical imaging device is a near-infrared Light Emitting Diode/phototransistor to view a restricted region along a line of the wrapped envelope.

19. The system for detecting an improperly wrapped envelope according to claim 10 wherein the threshold value is the difference between an actual value indicative of the edge location of the content material and a predefined reference value indicative of the edge location the sealing adhesive.

* * * * *